US007640940B2

(12) United States Patent
Jeon et al.

(10) Patent No.: US 7,640,940 B2
(45) **Date of Patent: *Jan. 5, 2010**

(54) DRIVE UNIT FOR DISH WASHING MACHINES

(75) Inventors: Si Moon Jeon, Seoul (KR); Tae Hee Lee, Bucheon-si (KR); Young Hwan Park, Seoul (KR)

(73) Assignee: LG Electronics Inc., Seoul (KR)

( * ) Notice: Subject to any disclaimer, the term of this patent is extended or adjusted under 35 U.S.C. 154(b) by 750 days.

This patent is subject to a terminal disclaimer.

(21) Appl. No.: 11/188,762

(22) Filed: Jul. 26, 2005

(65) Prior Publication Data

US 2006/0151016 A1 Jul. 13, 2006

(30) Foreign Application Priority Data

Jan. 12, 2005 (KR) ..... 10-2005-0002811

(51) Int. Cl.
*A47L 15/23* (2006.01)

(52) U.S. Cl. ..... 134/111; 134/56 D; 134/57 D; 134/58 D; 134/110; 134/184

(58) Field of Classification Search ..... 134/57 D, 134/111, 56 D, 58 D, 110, 176
See application file for complete search history.

(56) References Cited

U.S. PATENT DOCUMENTS 3,521,451 A * 7/1970 Langlois ..... 60/351
5,433,232 A * 7/1995 Young, Jr. ..... 134/111
RE37,831 E * 9/2002 Thies ..... 134/10
2005/0022849 A1 2/2005 Park et al.
2005/0120533 A1 6/2005 Yoon et al.
2006/0151010 A1* 7/2006 Jeon et al. ..... 134/56 D
2008/0072934 A1* 3/2008 Pyo et al. ..... 134/104.1

OTHER PUBLICATIONS

U.S. Appl. No. 10/988,510 to Yoon et al., filed Nov. 16, 2004.
U.S. Appl. No. 11/095,561 to Kim et al., filed Apr. 1, 2005.
U.S. Appl. No. 11/188,759 to Jeon et al., filed Jul. 26, 2005.

* cited by examiner

*Primary Examiner*—Joseph L. Perrin
*Assistant Examiner*—Benjamin Osterhout
(74) *Attorney, Agent, or Firm*—McKenna Long & Aldridge LLP

(57) ABSTRACT

A drive unit for dish washing machines includes a flow channel housing, a filter housing and an arm holder, which are thermally fused to one another to form an integral unit. Consequently, assembly of the drive unit is simplified, leakage of wash water is prevented, and pumping performance is increased. Also, the flow channel housing, the filter housing and the arm holder are concurrently fixed to a pump housing of the drive unit by fixing members. Consequently, the assembly process of the drive unit is simplified, and the coupling force between the components of the drive unit is increased.

14 Claims, 11 Drawing Sheets

DRIVE UNIT FOR DISH WASHING MACHINES

The present disclosure relates to subject matter contained in priority Korean Application No. 2005-0002811, filed on Jan. 12, 2005, the disclosure of which is herein expressly incorporated by reference in its entirety.

BACKGROUND OF THE INVENTION

1. Field of the Invention

The present invention relates to a dish washing machine, and more particularly, to a drive unit for dish washing machines that can be easily assembled and is capable of improving wash water filtering performance.

2. Discussion of the Related Art

Generally, a dish washing machine is a machine that injects wash water to dishes to wash the dishes, and heats the washed dishes to dry the washed dishes. A conventional dish washing machine is illustrated in FIG. 1. The construction of the conventional dish washing machine will be described hereinafter with reference to FIG. 1.

As illustrated in FIG. 1, the conventional dish washing machine comprises: upper and lower injection arms 4 and 5; upper and lower racks 6 and 7; and a drive unit 10, all of which are mounted in a tub 1. To the drive unit 10 are connected upper and lower connection pipes 2 and 3 for pumping out wash water and a drain hose 9 for draining the wash water. The upper and lower connection pipes 2 and 3 are connected to the upper and lower injection arms 4 and 5, respectively. The upper rack 6 is disposed above the upper injection arm 4, and the lower rack 7 is disposed above the lower injection arm 5.

The upper and lower injection arms 4 and 5 are rotatably disposed above the drive unit 10. Each of the upper and lower injection arms 4 and 5 has injection holes for allowing wash water to be injected to the corresponding rack therethrough. In addition, the lower injection arm 5 has injection holes for allowing wash water to be injected therethrough to remove food particles from a filter of the drive unit.

The drive unit 10 will now be described in detail with reference to FIG. 2. The drive unit 10 comprises: a sump 20 for receiving wash water; a heater 30 mounted to the sump 20 for heating wash water; a washing pump mounted to the sump 20 for pumping out wash water; a drain pump mounted to the sump 20 for draining wash water; and filtering device for guiding some of the pumped-out wash water to the upper and lower injection arms 4 and 5 and filtering the remainder of the pumped-out wash water.

The sump 20 has a wash water receiving space 21 for substantially receiving wash water defined therein. Also, the sump 20 has a drain chamber 22, which is partitioned from the wash water receiving space 21. To the outside of the wash water receiving space 21 is mounted a flow channel control device 25. To the flow channel control device 25 a flow channel control valve 26 is connected via a shaft. Also, the sump 20 has a plurality of bosses 29, to which the filtering device is fixed by fixing members.

The washing pump comprises: a washing motor 41 disposed below the sump 20 for generating a driving force; and an impeller 42 mounted in the filtering device for pumping out wash water. The impeller 42 is connected to a shaft of the washing motor 41. The drain pump is mounted to the drain chamber 22 of the sump 20. The drain pump comprises a drain motor 51 and a drain impeller 52.

The filtering device comprises: a pump housing 60 having a space for allowing the impeller 42 to be mounted therein; a filter housing 70 mounted for covering the top of the pump housing 60; and a cover 80 mounted for covering the top of the filter housing 70 and the top of the sump 20. The pump housing 60 is disposed at the lower surface of the filter housing 70. The cover 80 is disposed at the upper surface of the filter housing 70.

The filter housing 70 has a solid waste chamber 75 defined therein. The solid waste chamber 75 has an outlet port 75*a*, which communicates with the drain chamber 22. The outlet port 75*a* extends a predetermined length downward from the solid waste chamber 75 such that the outlet port 75*a* can be inserted into the drain chamber 22.

The cover 80 has a filter 81, which corresponds to the solid waste chamber 75 of the filter housing 70. At the cover, around the filter 81, are formed a plurality of collection holes 82. The collection holes 82 communicate with the sump 20.

The assembly of the drive unit 10 will now be described. At the edge of the pump housing 60 are formed a plurality of bosses 67. At the filter housing 70 are formed a plurality of fixing holes 77, which correspond to the bosses 67 of the pump housing 60, respectively. The fixing holes 77 of the filter housing 70 are arranged along a circumferential part, which is spaced a predetermined distance from the edge of the filter housing 70 toward the center of the filter housing 70. The bosses 67 have fixing holes formed therein, respectively. Consequently, the pump housing 60 is fixed to the filter housing 70 by inserting fixing members B1 into the fixing holes of the bosses 67 of the pump housing 60 through the fixing holes 77 of the filter housing 70, respectively.

At the edge of the filter housing 70 are also formed a plurality of bosses 78, which extend outward from the edge of the filter housing 70. At the cover 80 are formed a plurality of fixing holes 88, which correspond to the bosses 78 of the filter housing 70, respectively. The bosses 78 have fixing holes formed therein, respectively. Consequently, the filter housing 70 is fixed to the cover 80 by inserting fixing members B2 into the fixing holes of the bosses 78 of the filter housing 70 through the fixing holes 88 of the cover 80, respectively.

At the cover 80 are also formed a plurality of fixing holes 89, which correspond to the bosses 29 of the sump 20, respectively. Consequently, the cover 80 is fixed to the sump 20 by inserting fixing members B3 into fixing holes formed in the bosses 29 of the sump 20 through the fixing holes 89 of the cover 80, respectively. Since the cover 80 is supported by the sump 20, the pump housing 60 and the filter housing 70 do not fall. In this way, fixing between the pump housing 60 and the filter housing 70, between the filter housing 70 and the cover 80, and between the cover 80 and the sump 20 is accomplished by means of the fixing members B1, B2 and B3.

The filter housing 70 will now be described in detail with reference to FIG. 3. As shown in FIG. 3, the filter housing 70 comprises: a wash water inlet port 72 for allowing wash water pumped out from the impeller 42 to be introduced therethrough; main flow channels 73*a* and 73*b* and a sampling flow channel 74 connected to the wash water inlet port 72; and a solid waste chamber 75 connected to the sampling flow channel 74. At the outlet port 75*a* of the solid waste chamber 75 is mounted an opening/closing valve for allowing wash water and food particles to be discharged from the solid waste chamber 75 to the drain chamber 22 when a draining operation is performed.

At the wash water inlet port 72 of the filter housing 70 is rotatably mounted a flow channel control valve 26 for opening or closing the main flow channels 73*a* and 73*b*. The flow channel control valve 26 is connected to the flow channel control device 25, which is mounted to the sump 20, via a shaft. At the edge of the channel control valve 26 is formed an opening/closing rib 26*a* for opening or closing the main flow channels 73*a* and 73*b*.

The operation of the dish washing machine with the above-stated construction will now be described. The dish washing machine successively or selectively performs a preliminary washing operation, a main washing operation, a rinsing operation, a heating and rinsing operation, and a drying operation to wash dishes. Draining operations are performed between the respective operations. Hereinafter, the main washing operation will be described in detail.

When the main washing operation is initiated, the washing motor 41 is rotated, and therefore, the impeller 42 is rotated. The impeller 42 pumps out wash water (containing a detergent) from the sump 20 to the wash water inlet port 72 of the pump housing 60. At this time, the flow channel control device 25 is rotated, and therefore, the flow channel control valve 26 either selectively opens the main flow channels 73*a* and 73*b*, as shown in FIG. 5A, or simultaneously opens the main flow channels 73*a* and 73*b*, as shown in FIG. 3. As a result, some of the wash water in the wash water inlet port 72 is introduced into the upper injection arm 4 and/or the lower injection arm 5 through the main flow channel 73*a* and/or the main flow channel 73*b*, and the remainder of the wash water is introduced into the solid waste chamber 75 through the sampling flow channel 74.

Preferably, the flow channel control valve 26 simultaneously or alternately opens the main flow channels 73*a* and 73*b* such that the wash water can be supplied to not only the upper injection arm 4 but also the lower injection arm 5. At this time, some of the wash water is always introduced into the sampling flow channel 74 irrespective of which main flow channel(s) is opened by the flow channel control valve 26.

The wash water introduced into the sampling flow channel 74 is directly guided into the solid waste chamber 75. The wash water guided into the solid waste chamber 75 overflows through the filter 81, which is disposed above the solid waste chamber 75. At this time, the filter 81 filters the wash water such that foreign matter is separated from the wash water.

The filtered wash water and the wash water dropping from the upper and lower injection arms 4 and 5 is introduced again into the sump 20 through the collection holes 82 of the cover 80. In this way, the wash water is filtered. It should be noted that some of the wash water is not filtered for a short period of time, but almost all of the wash water is filtered during the main washing operation.

After the washing operation is completed as described above, a draining operation is initiated. When the draining operation is initiated, the drain pump 51 and 52 are operated. At this time, the wash water and the food particles are introduced into the drain pump 51 and impeller 52 from the sump 20 by a suction force of the drain pump 51 and impeller 52. At the same time, the wash water and the food particles are introduced into the drain pump 51 and impeller 52 from the solid waste chamber 75 through the outlet port 75*a*, as shown in FIG. 5B. The wash water and the food particles introduced into the drain pump 51 and impeller 52 are drained out of the dish washing machine through the drain hose 9.

However, the conventional dish washing machine has the following problems. First, the pump housing is not supported by the sump. The pump housing is fixed to the lower part of the filter housing. As a result, the fixing operation of the impeller to the shaft of the washing motor is very complicated, and therefore, time required to assemble the drive unit is increased.

Secondly, the assembly of the pump housing and the filter housing is accomplished by fixing members. After that, the assembly of the cover and the sump is accomplished by fixing members. As a result, the assembly of the drive unit is very complicated, and the number of fixing members is considerably increased.

Thirdly, the assembly of the pump housing and the filter housing is accomplished by fixing members, and the assembly of the filter housing and the cover is accomplished by fixing members, which are different from those used to assemble the pump housing and the filter housing. As a result, gaps are created between the pump housing and the filter housing and between the filter housing and the cover if the assembly of the pump housing and the filter housing and/or the assembly of the filter housing and the cover is not secure. Consequently, wash water leaks from the gaps created between the pump housing and the filter housing and between the filter housing and the cover, and therefore, wash water pumping performance is decreased. Furthermore, it is necessary to increase the capacity of the washing pump. Consequently, the size of the dish washing machine is increased, and therefore, the manufacturing costs of the dish washing machine are also increased.

Fourthly, the installation space for the solid waste chamber is seriously restricted due to the various flow channels of the filter housing. Consequently, filtering capacity is reduced, and the degree of freedom for installation of the solid waste chamber is decreased. Fifthly, the bottom surface of the solid waste chamber is horizontally disposed. Consequently, solid waste, such as food particles, remains in the solid waste chamber.

SUMMARY OF THE INVENTION

Accordingly, the present invention is directed to a drive unit for dish washing machines that substantially obviates one or more problems due to limitations and disadvantages of the related art.

An object of the present invention is to provide a drive unit for dish washing machines wherein the fixing operation of a motor and an impeller is simplified.

Another object of the present invention is to provide a drive unit for dish washing machines wherein assembly of the drive unit is simplified, and the number of fixing members is considerably reduced.

Another object of the present invention is to provide a drive unit for dish washing machines that is capable of preventing gaps from being created between components of the drive unit. Another object of the present invention is to provide a drive unit for dish washing machines that is capable of improving pumping performance of the dish washing machine, and reducing the size and the manufacturing costs of the dish washing machine.

A further object of the present invention is to provide a drive unit for dish washing machines that is capable of improving filtering capacity of the dish washing machine and facilitating discharge of solid waste when a draining operation is performed.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a drive unit for dish washing machines comprises: a sump for receiving wash water; and a pump housing positioned inside the sump such that the pump housing is supported by the sump, the pump housing having a washing impeller located therein; a flow channel housing positioned to cover the top of the pump housing, the flow channel housing having flow channels for guiding some of the wash water pumped out from the washing impeller to washing arms and having a solid waste chamber for filtering some of the pumped-out wash water; a filter housing thermally fused to the upper part of the flow channel housingto define an integral housing, the filter housing having a filter opening, which corresponds to the solid waste chamber; and an arm holder thermally fused to the upper part of the flow channel housingto define an integral structure, the arm holder having a filter positioned to cover the filter opening of the filter housing.

In another aspect of the present invention, a drive unit for dish washing machines comprises: a sump for receiving wash water; a pump housing positioned inside the sump such that the pump housing is supported by the sump, the pump housing having a washing impeller located therein; a flow channel housing positioned to cover a top of the pump housing, the flow channel housing having flow channels for guiding some of the wash water pumped out from the washing impeller to washing arms and having a solid waste chamber for filtering some of the pumped-out wash water; a filter housing positioned to cover a top of the flow channel housing, the filter housing having a filter opening, which corresponds to the solid waste chamber, and collection holes communicating with the sump for conveying the wash water to the sump; an arm holder disposed above the flow channel housing, the arm holder including a filter positioned to cover the filter opening of the filter housing; and fixing members for securely attaching the pump housing, the flow channel housing, the filter housing and the arm holder to the sump, the fixing members extending into the sump through the arm holder, the filter housing, the flow channel housing and the pump housing.

Preferably, the flow channel housing and the filter housing have communication holes, which are located in regions of the flow channel housing and the filter housing surrounded by the filter opening and the upper chamber, respectively, the communication holes communicating with the sump.

In a further aspect of the present invention, a drive unit for dish washing machines comprises: a sump for receiving wash water; a pump housing positioned inside the sump such that the pump housing is supported by the sump, the pump housing having a washing impeller located therein; a flow channel housing positioned to cover a top of the pump housing, the flow channel housing having flow channels for guiding some of the wash water pumped out from the washing impeller to washing arms, a solid waste chamber for filtering some of the pumped-out wash water, and a communication hole positioned such that the communication hole is spaced from the solid waste chamber and from the washing impeller, the communication hole communicating with the sump; a filter housing positioned to cover the top of the flow channel housing, the filter housing having a filter opening, which corresponds to the solid waste chamber, collection holes communicating with the sump for conveying the wash water to the sump, and a communication hole located in an area surrounded by the filter opening and the solid waste chamber; an arm holder positioned above the flow channel housing, the arm holder having a filter positioned to cover the filter opening of the filter housing; and fixing members for securely attaching the pump housing, the flow channel housing, the filter housing and the arm holder to the sump.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention.

The above and other objects, features and advantages of the present invention will be made apparent from the following description of the preferred embodiments, given as non-limiting examples, with reference to the accompanying drawings in which.

DETAILED DESCRIPTION OF THE INVENTION

Figure 1:
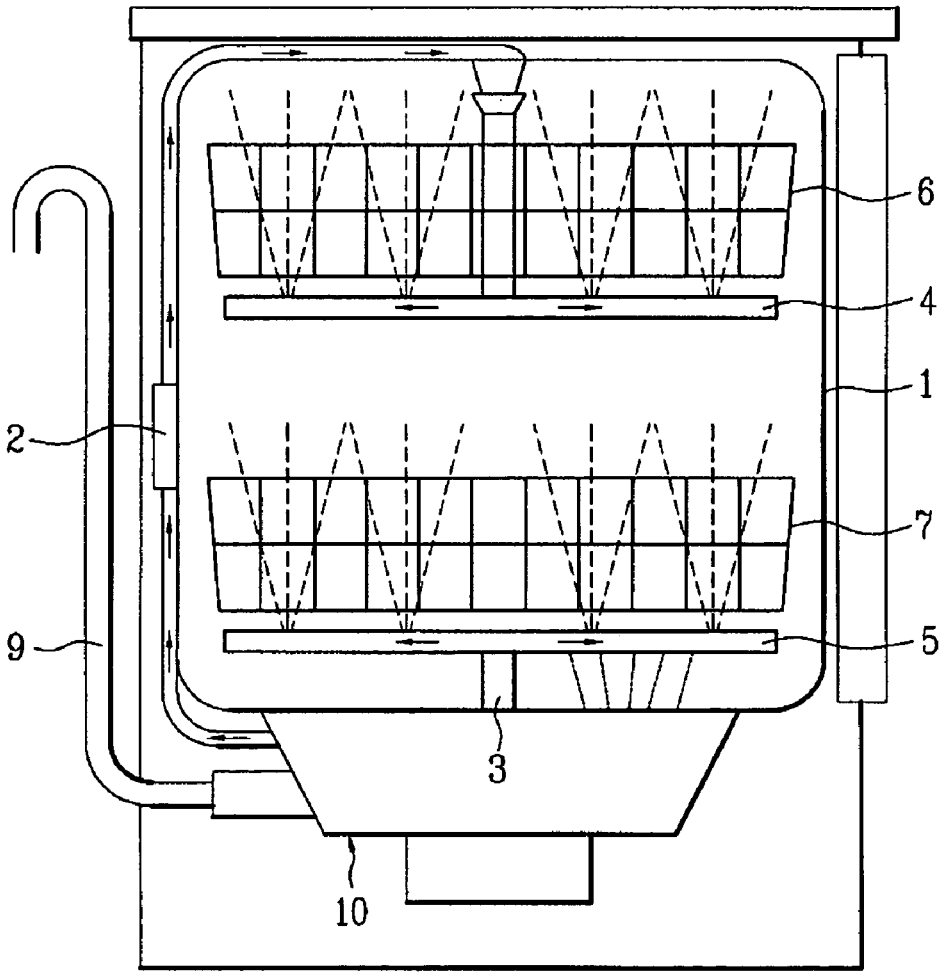
FIG. 1 Related Art
FIG. 1 is an elevation view illustrating the construction of a conventional dish washing machine.
Figure 2:
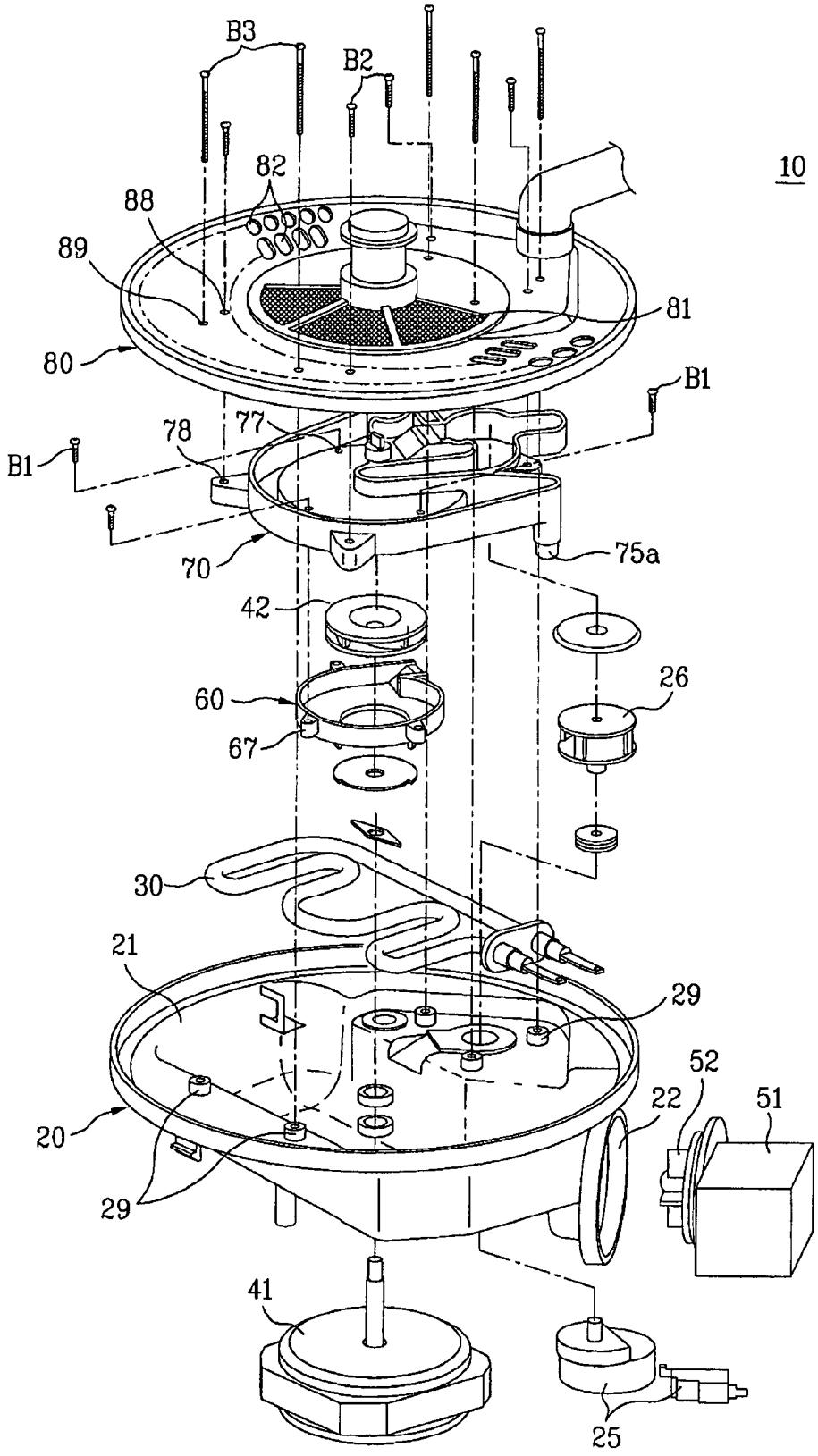
FIG. 2 Related Art
FIG. 2 is an exploded perspective view illustrating the drive unit for dish washing machines of FIG. 1.
Figure 3:
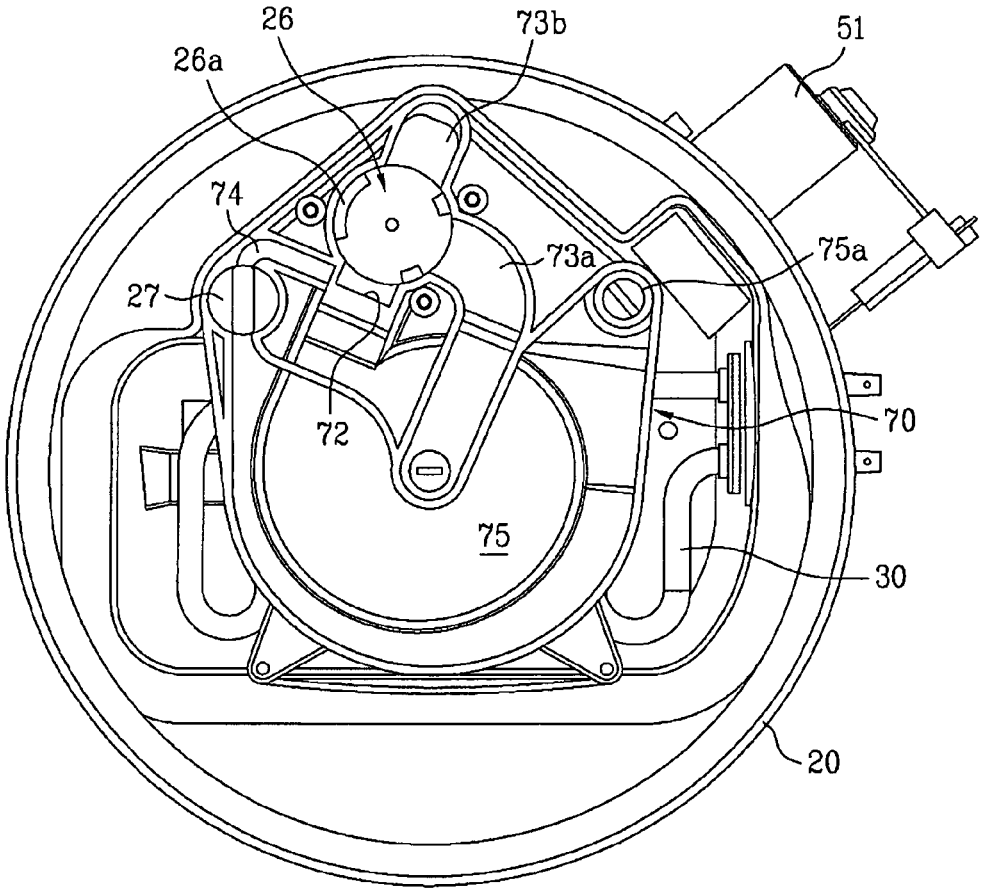
FIG. 3 Related Art
FIG. 3 is a plan view illustrating the structure of the flow channel of the filter housing of FIG. 2.
Figure 4:
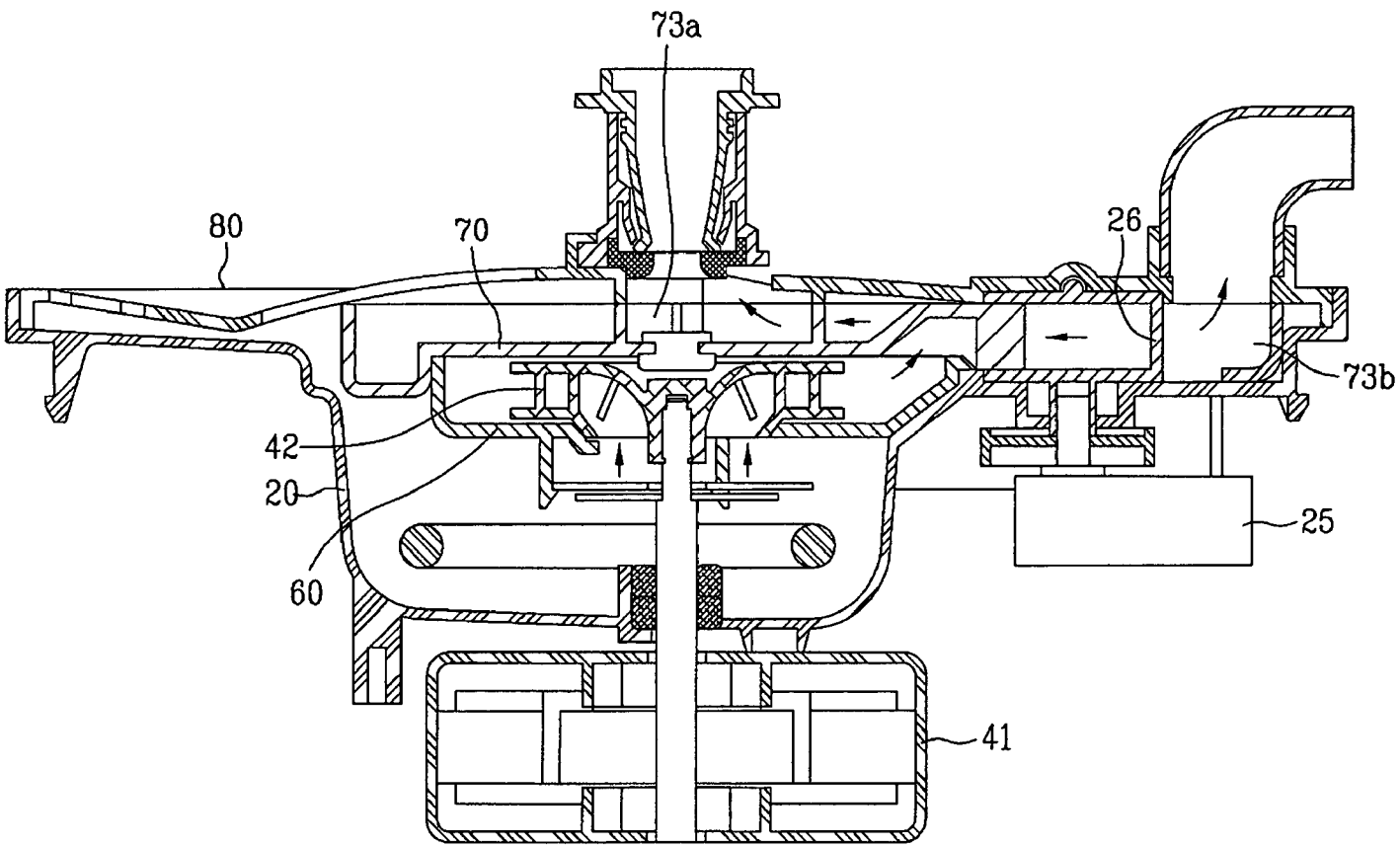
FIG. 4 Related Art
FIG. 4 is a sectional view illustrating flow of wash water in the drive unit of FIG. 2 when a washing operation is performed.
Figure 5A:
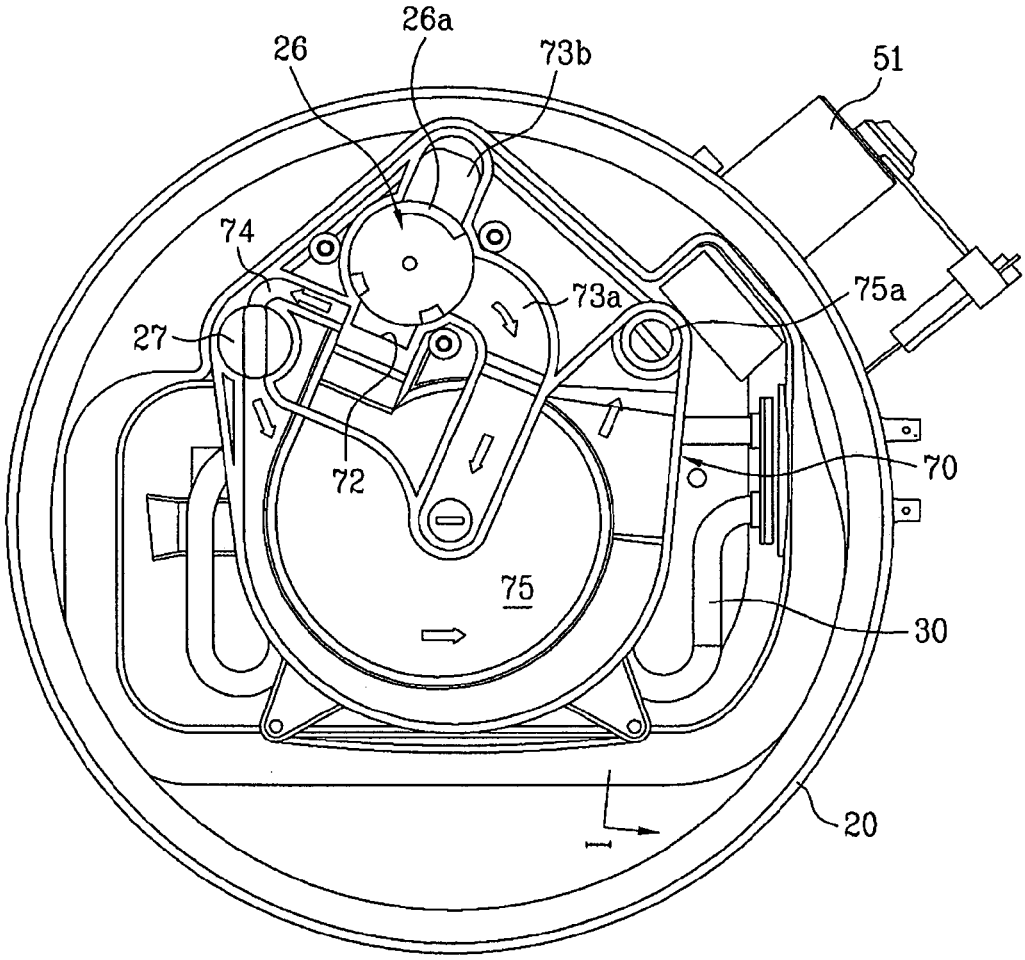
FIG. 5A Related Art
FIG. 5A is a plan view illustrating flow of wash water in the filter housing of FIG. 2 when a washing operation is performed.
Figure 5B:
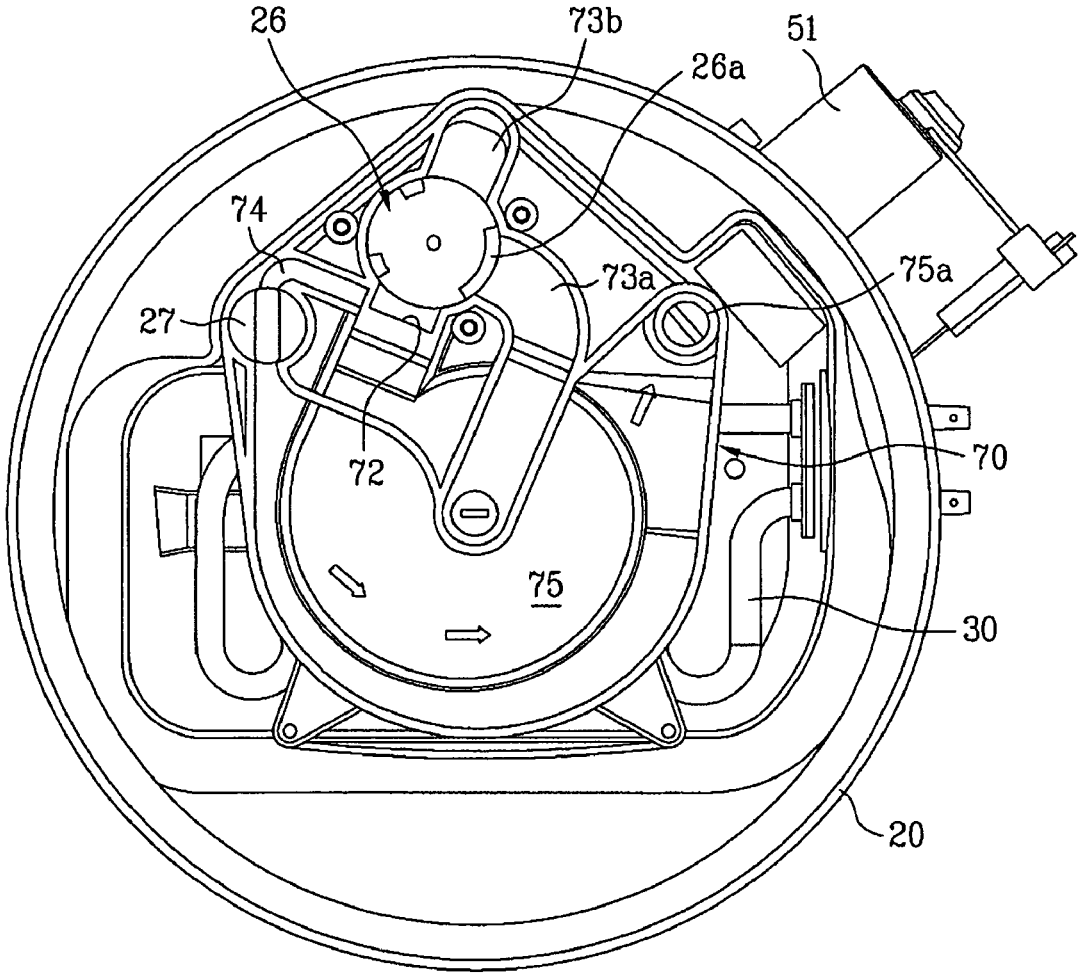
FIG. 5B Related Art
FIG. 5B is a plan view illustrating flow of wash water in the filter housing of FIG. 2 when a draining operation is performed.
Figure 6:
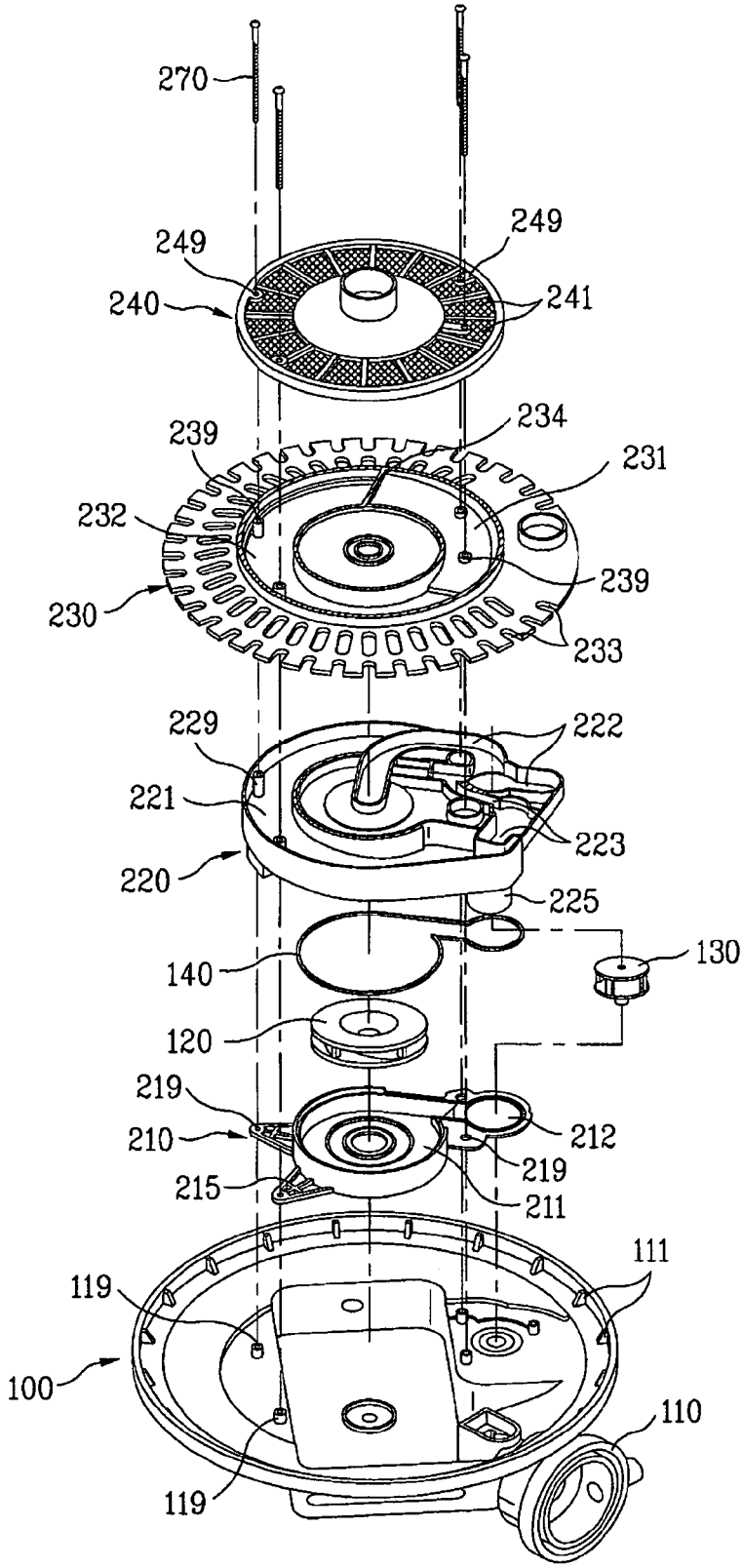
FIG. 6 is an exploded perspective view illustrating a drive unit for dish washing machines according to a first preferred embodiment of the present invention.

The present invention is further described in the detailed description which follows, by reference to the noted plurality of drawings by way of non-limiting examples of preferred embodiments of the present invention, in which like reference numerals represent similar parts throughout the several views of the drawings, and wherein:

FIG. 6 is an exploded perspective view illustrating a drive unit for dish washing machines according to a first preferred embodiment of the present invention. As shown in FIG. 6, the drive unit comprises: a sump 100 for receiving wash water; a pump housing 210 disposed inside the sump 100 such that the pump housing 210 is supported by the sump 100, the pump housing 210 having a washing impeller 120 located therein; a flow channel housing 220 disposed to cover the top of the pump housing 210, the flow channel housing 220 having flow channels 222 for guiding some of the wash water pumped out from the washing impeller 120 to washing arms and a solid waste chamber 221 for filtering some of the pumped-out wash water; a filter housing 230 integrally fixed to the upper part of the flow channel housing 220 by thermal fusion, the filter housing 230 having a filter opening 232, which corresponds to the solid waste chamber 221; and an arm holder 240 integrally fixed to the upper part of the filter housing 230 by thermal fusion. The arm holder 240 has a filter 241 disposed to cover the filter opening 232 of the filter housing 230.

While the pump housing 210 is disposed inside the sump 100 such that the pump housing 210 is supported by the sump 100, the washing impeller 120 is securely fitted onto the shaft of a washing motor, and then the thermally-fused integral body (i.e., the flow channel housing 220, the filter housing 230 and the arm holder 240) is securely attached to the pump housing 210. Consequently, assembly of the drive unit is simplified. Also, leakage of wash water from between the housings is prevented since the flow channel housing 220, the filter housing 230 and the arm holder 240 are integrally fixed to one another by thermal fusion. Consequently, pumping performance is increased. Furthermore, the number of the bosses and the fixing holes formed at the thermally-fused integral body is considerably decreased as compared to the prior art. Consequently, the structure of the drive unit is simplified, and the degree of freedom for designing the drive unit is increased as compared to the prior art.

Referring to FIG. 6, the flow channel housing 220, the filter housing 230 and the arm holder 240 that are integrally fixed to one another by thermal fusion are shown separated from one another. For example, the flow channel housing 220, the filter housing 230 and the arm holder 240 are separated from one another by cutting. The cut parts are hatched as shown in FIG. 6.

Preferably, the flow channel housing 220, the filter housing 230 and the arm holder 240, which are integrally fixed to one another by thermal fusion, and the pump housing 210 are securely attached to the sump 100 by means of fixing members, which are inserted through the arm holder 240, the filter housing 230, the flow channel housing 220 and the pump housing 210. In other words, only two components, i.e., the pump housing 210 and the thermally-fused integral body, are securely attached to the sump 100 by means of the fixing members. Consequently, the assembly of the drive unit is simplified. In addition, a sealing member 140 is interposed between the pump housing 210 and the thermally-fused integral body.

The housing coupling structure will now be described in detail. At the sump 100 are formed a plurality of bosses 119. At the pump housing 210 are formed fixing holes 219, which correspond to the bosses 119 of the sump 100, respectively. At the edge of the pump housing 210 are formed supporting parts 215, which extend outward from the edge of the pump housing 210. The fixing holes 219 are also formed at the supporting parts 215 of the pump housing 210. At the thermally-fused integral body are formed bosses 229 and 239 and fixing holes 249, which correspond to the fixing holes 219 of the pump housing 210 and the bosses 119 of the sump 100, respectively. Specifically, the bosses 229 and 239 are formed at the flow channel housing 220 and the filter housing 230, respectively. The bosses 229 of the flow channel housing 220 correspond to the bosses 119 of the sump 100, respectively. Also, the bosses 239 of the filter housing 230 correspond to the bosses 119 of the sump 100, respectively. The fixing holes 219 and 249 are formed at the pump housing 210 and the arm holder 240, respectively. The fixing holes 219 of the pump housing 210 correspond to the bosses 119 of the sump 100, respectively. Also, the fixing holes 249 of the arm holder 240 correspond to the bosses 119 of the sump 100, respectively. Consequently, the sump 100, the pump housing 210 and the thermally-fused integral body are arranged such that the bosses and the fixing holes are aligned as described above, and then the thermally-fused integral body and the pump housing 210 are securely attached to the sump 100 by means of fixing members 270 at one time.

The filter housing 230 has an upper chamber 231 whose bottom surface is higher, by a predetermined amount, than the bottom surface of the solid waste chamber 221 such that the bottom surfaces of the upper chamber 231 and the solid waste chamber 221 are arranged in the shape of a step. The upper chamber 231 communicates with the solid waste chamber 221. The filter 241 of the arm holder 240 is disposed to cover the solid waste chamber 221 and the upper chamber 231. It should be noted, however, that the solid waste chamber 221 and the upper chamber 231 are nominally classified (or arbitrarily designated), and therefore, the solid waste chamber 221 and the upper chamber 231 substantially constitute a single solid waste chamber.

The upper chamber 231 is disposed such that the upper chamber 231 deviates (i.e., extends away from) the solid waste chamber 221. For example, the upper chamber 231 and the solid waste chamber 221 are connected to each other and are configured to have the shape of a ring. Preferably, the upper chamber 231 is constructed to cover the top of a predetermined region of the flow channel housing 220 where a flow channel control valve 130 and main flow channels 222 are disposed. As a result, the region of the flow channel housing 220 where the solid waste chamber cannot be formed due to the flow channel control valve and the main flow channels in the conventional art is used as the solid waste chamber, and therefore, the size of the solid waste chamber is considerably increased. However, the shape of the solid waste chamber 221 and the upper chamber 231 is not limited to the above-mentioned ring. For example, the solid waste chamber 221 and the upper chamber 231 may be formed in the shape of a square or rectangular frame, or a triangular frame.

At the solid waste chamber 221 is formed an inlet/outlet port 225 for allowing wash water to be introduced into the solid waste chamber 221 through the port 225 when a washing operation is performed and allowing solid waste, which is separated from the wash water by filtering, to be discharged out of the solid waste chamber 221 through the port 225 when a draining operation is performed. Preferably, the bottom surface of the solid waste chamber 221 and the bottom surface of the upper chamber 231 are inclined downward toward the inlet/outlet port 225. In this case, the wash water is smoothly discharged from the solid waste chamber 221 and the upper chamber 231 to a drain chamber 110 when the draining operation is performed.

Preferably, the solid waste chamber 221 and the upper chamber 231 communicate with each other in the vicinity of the inlet/outlet port 225. Also preferably, the solid waste chamber 221 and the upper chamber 231 are partitioned from each other at the side opposite to the inlet/outlet port 225. For example, both ends of the solid waste chamber 221 are connected to both ends of the upper chamber 231 when the solid waste chamber 221 and the upper chamber 231 are connected to each other such that the solid waste chamber 221 and the upper chamber 231 are arranged in the shape of a ring. At one of the two connections where the solid waste chamber 221 and the upper chamber 231 are connected to each other, which is opposite to the inlet/outlet port 225, is formed a partition rib 234. Consequently, circulation of wash water along the solid waste chamber 221 and the upper chamber 231 is prevented by the partition rib 234.

The inlet/outlet port 225 has two flow channels (not shown) formed vertically therethrough. The two flow channels are partitioned from each other such that one of the flow channels communicates with a sampling flow channel 223 and the drain chamber 110 while the other flow channel communicates with the drain chamber 110 and the solid waste chamber 221. As a result, the sampling flow channel 223, the drain chamber 110, and the solid waste chamber 221 communicate with one another.

At the edge of the filter housing 230 are formed collection holes 233. Each of the collection holes 233 is open to outside, and communicates with the sump 100. At the upper end of the edge of the sump 100 are preferably formed fixing ribs 111, which are inserted into the collection holes 233 of the filter housing 230, respectively. The filter housing 230 is prevented from being rotated by the provision of the fixing ribs 111.

Figure 7:
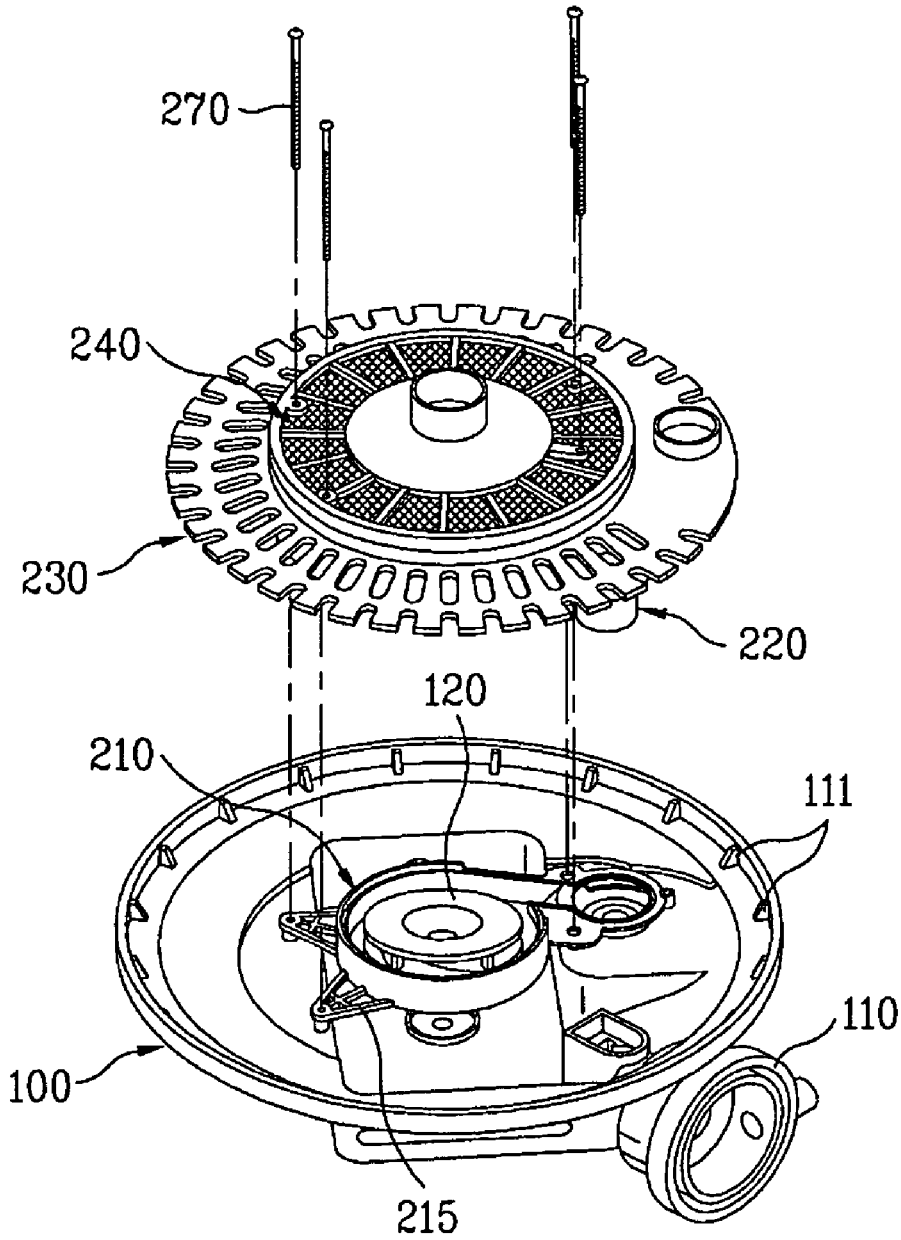
FIG. 7 is an exploded perspective view illustrating the assembly sequence of the drive unit for dish washing machines of FIG. 6.

The assembly process of the drive unit for dish washing machines according to the first preferred embodiment of the present invention will now be described with reference to FIG. 7. When the pump housing 210 is disposed inside the sump 100 as shown in FIG. 7, the fixing holes 219 of the pump housing 210 are aligned with the bosses 119 of the sump 100, respectively. At this time, the supporting parts 215 of the pump housing 210 are supported by the sump 100. After the pump housing 210 is disposed in the sump 100, the washing impeller 120 is securely fitted onto the shaft of the washing motor.

After the washing impeller 120 is securely fitted on the shaft of the washing motor, the thermally-fused integral body (i.e., the flow channel housing 220, the filter housing 230 and the arm holder 240) is placed above the pump housing 210 such that the bosses 229 and 239 and fixing holes 249 of the thermally-fused integral body and the fixing holes 219 of the pump housing 210 are aligned with the corresponding bosses 119 of the sump 100. Subsequently, the fixing members 270 are inserted into the bosses 119 of the sump 100 through the fixing holes 249, the bosses 239, the bosses 229, and the fixing holes 219, respectively, at one time. In this way, the drive unit is easily and conveniently assembled.

Figure 8:
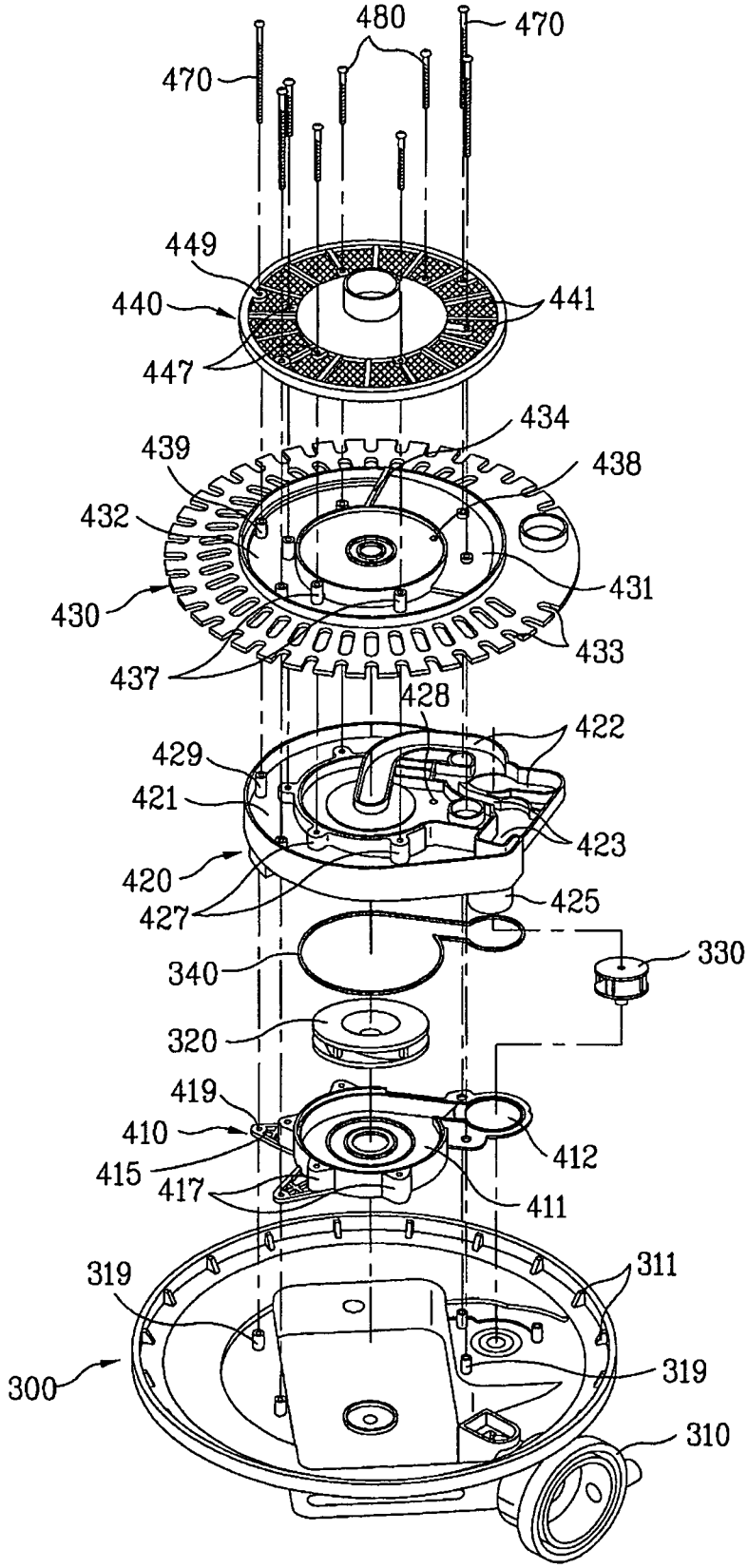
FIG. 8 is an exploded perspective view illustrating a drive unit for dish washing machines according to a second preferred embodiment of the present invention.

FIG. 8 is an exploded perspective view illustrating a drive unit for dish washing machines according to a second preferred embodiment of the present invention. As shown in FIG. 8, the drive unit for dish washing machines comprises: a sump 300 for receiving wash water; a pump housing 410 disposed inside the sump 300 such that the pump housing 410 is supported by the sump 300, the pump housing 410 having a washing impeller 320 located therein; a flow channel housing 420 disposed to cover the top of the pump housing 410, the flow channel housing 420 having flow channels 422 for guiding some of the wash water pumped out from the washing impeller 320 to washing arms and a solid waste chamber 421 for filtering some of the pumped-out wash water; a filter housing 430 disposed to cover the top of the flow channel housing 420, the filter housing 430 having a filter opening 432, which corresponds to the solid waste chamber 421, and collection holes communicating with the sump 300 for conveying the wash water to the sump 300; an arm holder 440 disposed above the flow channel housing 420, the arm holder 440 having a filter 441 disposed to cover the filter opening 432 of the filter housing 430; and fixing members 470 and 480 for securely attaching the pump housing 410, the flow channel housing 420, the filter housing 430 and the arm holder 440 to the sump 300. The fixing members 470 and 480 are inserted into the sump 300 through the arm holder 440, the filter housing 430, the flow channel housing 420 and the pump housing 410 in order.

While the pump housing 410 is disposed inside the sump 300 such that the pump housing 410 is supported by the sump 300, the washing impeller 320 is fitted onto the shaft of a washing motor. As a result, the assembly process of the drive unit is simplified. Also, the housings of the drive unit are securely coupled with one another at one time, since the fixing members 470 and 480 are inserted into the sump 300 through the arm holder 440, the filter housing 430, the flow channel housing 420 and the pump housing 410 in order. Consequently, the assembly process of the drive unit is simplified, and the coupling force between the housings is considerably increased. Between the pump housing 410 and the flow channel housing 420 is disposed a sealing member 340.

The housing coupling structure will now be described in detail. At the sump 300 are formed a plurality of bosses 319. At the pump housing 410 and the arm holder 440 are formed fixing holes 419 and 449, which correspond to the bosses 319 of the sump 300, respectively. At the flow channel housing 420 and the filter housing 430 are formed bosses 429 and 439, which also correspond to the bosses 319 of the sump 300, respectively. The fixing members 470 are inserted into the bosses 319 of the sump 300 through the fixing holes 449 of the arm holder 440, the bosses 439 of the filter housing 430, the bosses 429 of the flow channel housing 420, and the fixing holes 419 of the pump housing 410 in order.

At the edge of the pump housing 410 are formed a plurality of bosses 417. At the flow channel housing 420 are formed bosses 427, which correspond to the bosses 417 of the pump housing 410, respectively. At the filter housing 430 are formed bosses 437, which correspond to the bosses 417 of the pump housing 410, respectively. At the arm holder 440 are formed fixing holes 447, which also correspond to the bosses 417 of the pump housing 410, respectively. The fixing members 480 are inserted into the bosses 417 of the pump housing 410 through the fixing holes 447 of the arm holder 440, the bosses 437 of the filter housing 430, and the bosses 427 of the flow channel housing 420 in order. In this way, the housings are arranged such that the housings are vertically stacked, and then the housings are securely coupled with one another by means of the fixing members 470 and 480. Consequently, the drive unit is assembled at one time.

At the filter housing 430 is also formed an upper chamber 431, in addition to the solid waste chamber 421. The solid waste chamber 421 and the upper chamber 431 are substantially identical to those of the first preferred embodiment of the present invention. Therefore, a detailed description of the solid waste chamber 421 and the upper chamber 431 will not be given.

Preferably, communication holes 428 and 438 are formed at the regions of the flow channel housing 420 and the filter housing 430 surrounded by the filter opening 432 and the upper chamber 431. The communication holes 428 and 438 communicate with the sump 300 for discharging leaked wash water to the sump 300. Also preferably, the communication holes 428 and 438 are disposed such that the communication holes 428 and 438 deviate from an impeller location part 311 where the washing impeller 320 is located. In addition, collection holes 433 are formed at the edge of the filter hosing 430. Each of the collection holes 433 opens to the outside, and communicates with the sump 300.

The assembly process of the drive unit according to the second preferred embodiment is very similar to that of the first preferred embodiment, and therefore, a detailed description will not be given of the assembly process of the drive unit according to the second preferred embodiment. However, the drive unit according to the second preferred embodiment is characterized in that that the flow channel housing 420, the filter housing 430, and the arm holder 440 are individually prepared, and are then securely coupled with one another by means of the fixing members 470 and 480. The drive unit according to the second preferred embodiment is further characterized in that the housings are coupled with one another by means of the fixing members at one time, whereby the coupling force between the housings is increased, and leakage of the wash water is effectively prevented. Also, the drive unit according to the second preferred embodiment is characterized in that the communication holes 428 and 438 are provided to discharge wash water leaking from the solid waste chamber 421 and the upper chamber 431, although no communication holes are necessary for the drive unit according to the first preferred embodiment of the present invention, which includes the thermally-fused integral body as previously described.

The operation of the drive unit for dish washing machines with the above-stated construction according to the present invention will now be described in detail. The operation of the drive unit according to the first preferred embodiment is identical to that of the second preferred embodiment. Hereinafter, the operation of the drive unit according to the second preferred embodiment will be described.

Figure 9:
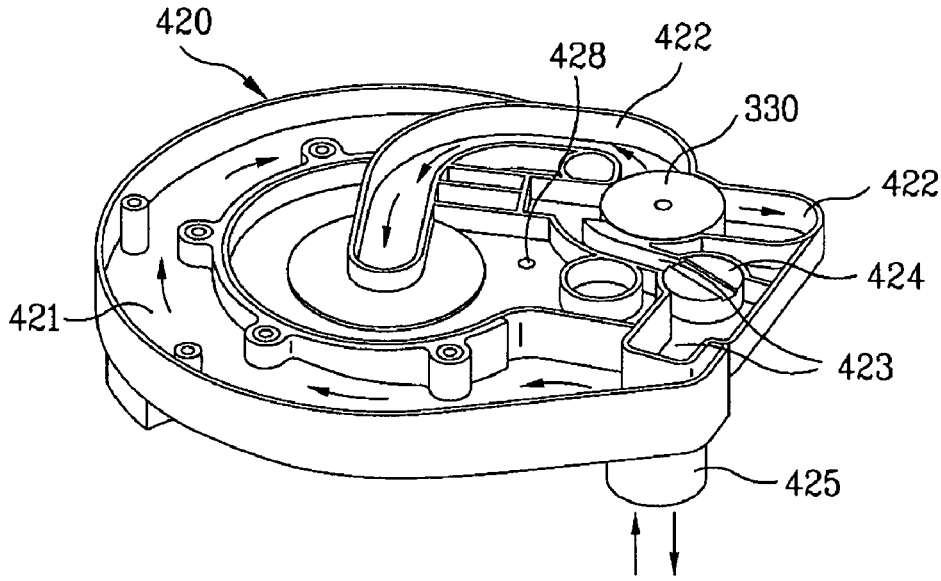
FIG. 9 is a perspective view illustrating flow of wash water in the flow channel housing of FIG. 6 when a washing operation is performed.

A main washing operation will be described with reference to FIGS. 9 to 11. When the main washing operation is initiated, the impeller 320 introduces wash water from the sump 300 to the impeller location part 411. The wash water is pumped out, and is then introduced to the wash water inlet port of the flow channel housing 420.

As the flow channel control valve 330 is rotated, the main flow channels 422 are selectively, simultaneously, or alternately opened or closed. At this time, some of the pumped-out wash water is introduced into the upper injection arm and/or the lower injection arm through the main flow channels 422. Also, some of the pumped-out wash water is introduced into the sampling flow channel 423. At this time, the wash water is introduced into the sampling flow channel 423 irrespective of which main flow channel(s) 422 is opened by the flow channel control valve 330.

The wash water introduced into the sampling flow channel 423 flows into the drain chamber 310 through the inlet/outlet port 425. A pollution level detector 424 is mounted in the sampling flow channel 423. The pollution level detector 424 (which can be of a suitable construction or type) serves to detect the pollution level of the wash water and transmit the detected pollution level of the wash water to a control unit.

Relatively large-sized food particles, which are contained in the wash water in the drain chamber 310, are deposited on the bottom surface of the drain chamber 310. Consequently, the food particles are primarily separated from the wash water in the drain chamber 310. The drain chamber 310 serves as a submerged tank when the washing operation is performed.

Figure 10:
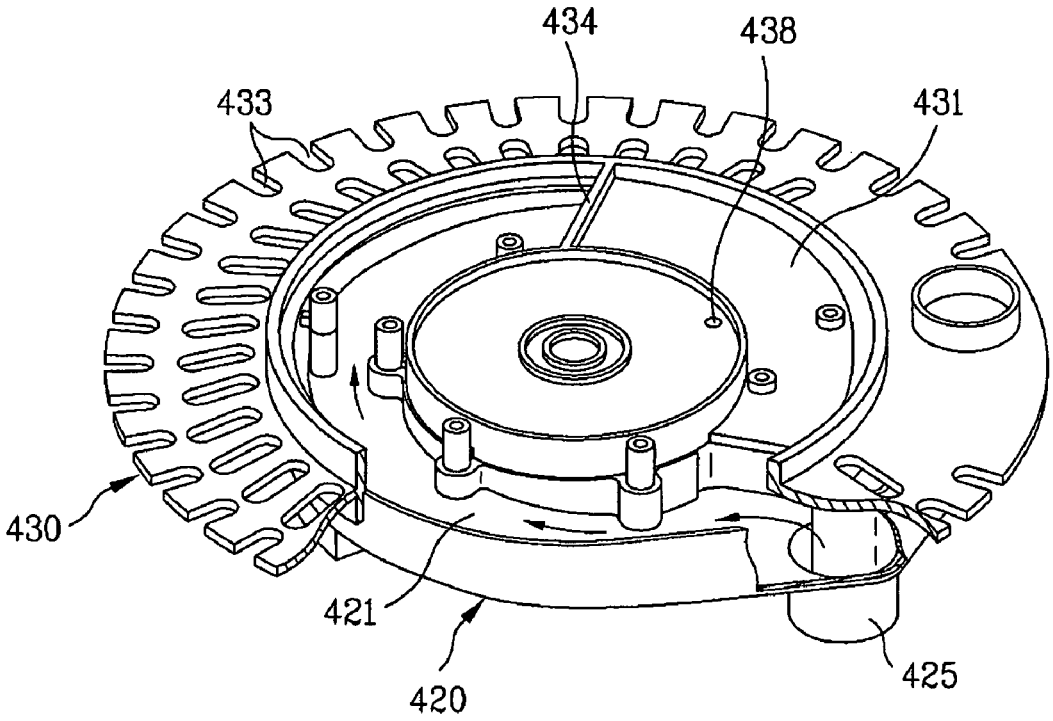
FIGS. 10 and 11 are perspective views illustrating flow of wash water in the housing assembly of FIG. 6 when a washing operation is performed.

Referring to FIG. 10, the wash water introduced into the drain chamber 310 flows into the solid wasted chamber 421 through the inlet/outlet port 425. At this time, food particles are accumulated in the solid waste chamber 421 from the partition rib side to the wash water inlet side. Also, relatively small-sized food particles are introduced into the solid waste chamber 421, and therefore, the amount of food particles introduced into the solid waste chamber 421 is decreased.

Figure 11:
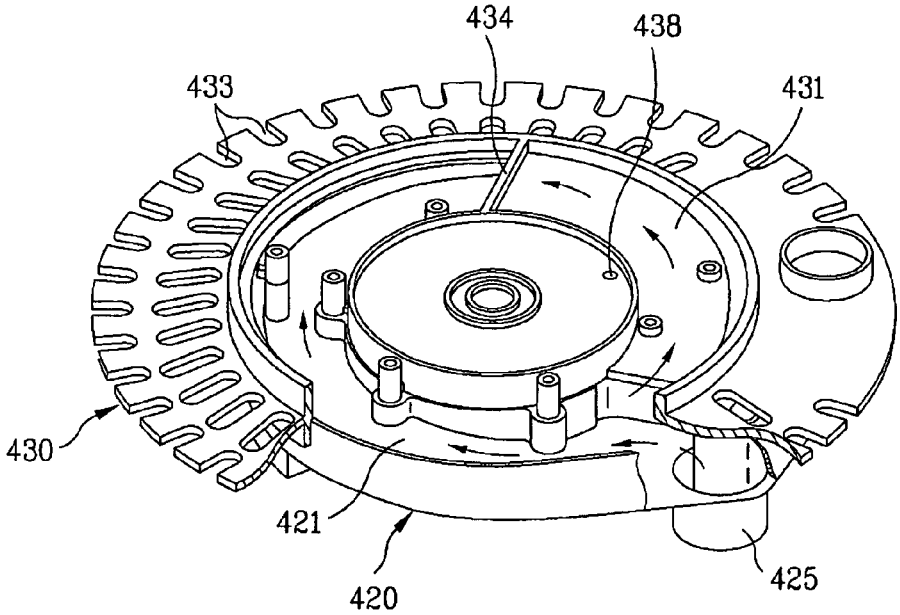

As the amount of wash water introduced into the solid waste chamber 421 is gradually increased, the wash water is introduced into the upper chamber 431, as shown in FIG. 11. At this time, the partition rib 434 prevents the wash water from flowing from the solid waste chamber 421 to the upper chamber 431. Also, food particles are accumulated in the upper chamber 431 from the partition rib side to the wash water inlet side. As a result, the filter 441 is effectively prevented from being blocked.

As described above, the wash water is introduced into the solid waste chamber 421 and the upper chamber 431 via the drain chamber 310. Consequently, the water pressure applied to the solid waste chamber 421 and the upper chamber 431 is relatively decreased as compared to the prior art. Also, the wash water primarily filtered in the drain chamber 310 is introduced into the solid waste chamber 421 and the upper chamber 431. As a result, the amount of food particles introduced into the solid waste chamber 421 and the upper chamber 431 is decreased compared to the prior art. Also, the upper chamber 431 is formed such that the upper chamber 431 can cover the top of the main flow channels 422 and the flow channel control valve 330, and therefore, the filtering capacity is increased. Furthermore, the food particles are accumulated in the solid waste chamber 421 and the upper chamber 431 from the partition rib side to the wash water inlet side, and therefore, the filter 441 is effectively prevented from being blocked.

The wash water introduced into the solid waste chamber 421 as described above overflows through the filter 441. At this time, relatively small-sized food particles contained in the wash water are secondarily separated from the wash water by the filter 441. The filtered wash water is introduced again into the sump 300 through the collection holes 433 of the filter housing 430. Here, the pumping force of the impeller 320 creates water pressure, by which the wash water is introduced into the solid waste chamber 421 and the upper chamber 431 via the drain chamber 310.

A small amount of wash water leaks through gaps between the flow channel housing 420, the filter housing 430 and the arm holder 440, and is then introduced into the regions of the flow channel housing 420 and the filter housing 430 surrounded by the solid waste chamber 421 and the upper chamber 431. The leaked wash water is collected into the sump 300 through the communication holes 428, 438. Consequently, the drive unit is sanitarily used.

Figure 12:
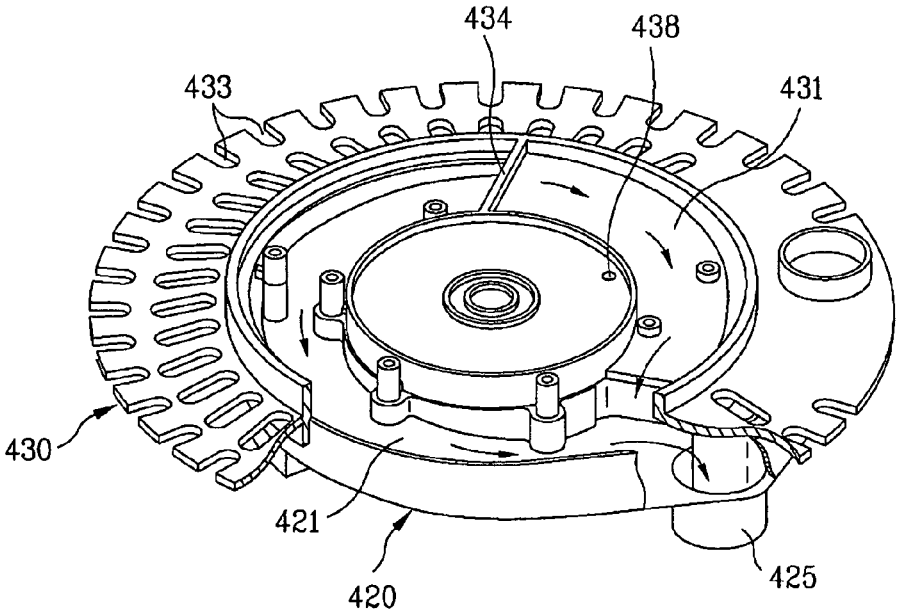
FIG. 12 is a perspective view illustrating flow of wash water in the housing assembly of FIG. 6 when a draining operation is performed.

After the washing operation is completed, a draining operation is initiated. When the draining operation is initiated, the drain pump is operated. At this time, the wash water and the food particles are introduced into the drain chamber 310 from the sump 300. At the same time, the wash water and the food particles are introduced into the drain chamber 310 from the solid waste chamber 421 and the upper chamber 431 through the inlet/outlet port 425, as shown in FIG. 12. The bottom surfaces of the solid waste chamber 421 and the upper chamber 431 are inclined downward toward the inlet/outlet port 425. Consequently, discharge of the food particles from the solid waste chamber 421 and the upper chamber 431 is facilitated. Also, circulation of the food particles is prevented by the partition rib 434. Consequently, the food particles are completely discharged when the wash water is drained. The wash water and the food particles introduced into the drain chamber 310 are drained out of the dish washing machine through the drain port.

As apparent from the above description, the drive unit for dish washing machines according to the present invention has the following effects. First, the pump housing is disposed inside the sump such that the pump housing is supported by the sump, and then the washing impeller is fitted onto the shaft of the washing motor, according to the first and second preferred embodiments of the present invention. Consequently, easy and convenient coupling between the shaft of the washing motor and the washing impeller is accomplished, and therefore, time required to assemble the drive unit is reduced.

Secondly, the fixing members are inserted through the arm holder, the filter housing, and the pump housing, according to the first and second preferred embodiments of the present invention. Consequently, the assembly process of the drive unit is simplified. Furthermore, the number of the fixing members is considerably decreased.

Thirdly, the flow channel housing, the filter housing and the arm holder are integrally fixed to one another by thermal fusion to constitute the thermally-fused integral body, according to the first preferred embodiment of the present invention. Consequently, leakage of wash water from between the housings is effectively prevented. As a result, decrease of wash water pumping performance due to the leakage of wash water is prevented, and therefore, it is not necessary to increase the capacity of the washing pump. Furthermore, the size and the manufacturing costs of the dish washing machine are reduced.

Fourthly, the upper chamber is disposed to cover the tops of the various flow channels of the flow channel housing. As a result, the size of the soiled water chamber is increased. Consequently, filtering capacity is considerably increased, and the degree of freedom for installation of the solid waste chamber is increased. Fifthly, the bottom surfaces of the solid waste chamber and the upper chamber are inclined downward toward the wash water draining side. As a result, discharge of food particles is facilitated when the draining operation is performed.

Although the invention has been described with reference to an exemplary embodiment, it is understood that the words that have been used are words of description and illustration, rather than words of limitation. Changes may be made, within the purview of the appended claims, as presently stated and as amended, without departing from the scope and spirit of the present invention in its aspects. Although the invention has been described herein with reference to particular means, materials and embodiments, the invention is not intended to be limited to the particulars disclosed herein. Instead, the invention extends to all functionally equivalent structures, methods and uses, such as are within the scope of the appended claims.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

What is claimed is:

1. A drive unit for dish washing machines, comprising:

a sump for receiving wash water;

a pump housing positioned inside the sump such that the pump housing is supported by the sump, the pump housing having a washing impeller located therein;

a flow channel housing positioned to cover the top of the pump housing, the flow channel housing having flow channels for guiding some of the wash water pumped out from the washing impeller to washing arms and having a solid waste chamber for filtering some of the pumped-out wash water;

a filter housing thermally fused to the upper part of the flow channel housing to define an integral housing, the filter housing having a filter opening, which corresponds to the solid waste chamber and having an upper chamber for filtering some of the pumped-out wash water disposed such that the upper chamber deviates from the solid waste chamber; and an arm holder thermally fused to the upper part of the filter housing to define an integral structure, the arm holder having a filter positioned to cover the filter opening of the filter housing, wherein the upper chamber has a bottom surface that is higher, by a predetermined amount, than a bottom surface of the solid waste chamber such that the bottom surfaces of the upper chamber and the solid waste chamber are configured to define a stepped structure, the upper chamber communicating with the solid waste chamber, and the filter of the arm holder is positioned to cover the solid waste chamber and the upper chamber.

2. The drive unit as set forth in claim 1, wherein the pump housing, the flow channel housing, the filter housing, and the arm holder are securely attached to the sump by fixing members, which concurrently extend through the arm holder, the filter housing, the flow channel housing, and the pump housing.

3. The drive unit as set forth in claim 1, wherein the upper chamber is configured to extend away from the solid waste chamber.

4. The drive unit as set forth in claim 3, wherein the solid waste chamber has an inlet/outlet port that allows wash water to be introduced into the solid waste chamber through the inlet/outlet port when a washing operation is performed and that allows solid waste, which is separated from the wash water by filtering, to be discharged out of the solid waste chamber through the inlet/outlet port when a draining operation is performed.

5. The drive unit as set forth in claim 4, wherein the bottom surface of the solid waste chamber and the bottom surface of the upper chamber are inclined downward toward the inlet/outlet port.

6. The drive unit as set forth in claim 4, wherein the solid waste chamber and the upper chamber communicate with each other in the vicinity of the inlet/outlet port, and the solid waste chamber and the upper chamber are separated from each other at the side opposite to the inlet/outlet port.

7. The drive unit as set forth in claim 3, wherein an edge of the filter hosing comprising collection holes, each of the collection holes being open towards the outside of the filter housing.

8. A drive unit for dish washing machines, comprising:

a sump for receiving wash water;

a pump housing positioned inside the sump such that the pump housing is supported by the sump, the pump housing having a washing impeller located therein;

a flow channel housing positioned to cover the top of the pump housing, the flow channel housing having flow channels for guiding some of the wash water pumped out from the washing impeller to washing arms and having a solid waste chamber for filtering some of the pumped-out wash water;

a filter housing positioned to cover a top of the flow channel housing, the filter housing having a filter opening which corresponds to the solid waste chamber and having collection holes communicating with the sump for conveying the wash water to the sump and having an upper chamber for filtering some of the pumped-out wash water disposed such that the upper chamber deviates from the solid waste chamber;

an arm holder positioned above the flow channel housing, the arm holder including a filter positioned to cover the filter opening of the filter housing; and fixing members for securely attaching the pump housing, the flow channel housing, the filter housing and the arm holder to the sump, the fixing members extending into the sump through the arm holder, the filter housing, the flow channel housing and the pump housing, wherein the upper chamber has a bottom surface that is higher, by a predetermined amount, than a bottom surface of the solid waste chamber such that the bottom surfaces of the upper chamber and the solid waste chamber are configured to define a stepped structure, the upper chamber communicating with the solid waste chamber, and the filter of the arm holder is positioned to cover the solid waste chamber and the upper chamber.

9. The drive unit as set forth in claim 8, wherein the flow channel housing and the filter housing have communication holes, which are located in the regions of the flow channel housing and the filter housing surrounded by the filter opening and the upper chamber, respectively, the communication holes communicating with the sump.

10. The drive unit as set forth in claim 9, wherein the communication holes are located so as to be spaced from the washing impeller.

11. The drive unit as set forth in claim 8, wherein the solid waste chamber has an inlet/outlet port for allowing wash water to be introduced into the solid waste chamber when a washing operation is performed and for allowing solid waste, which is separated from the wash water by filtering, to be discharged out of the solid waste chamber when a draining operation is performed.

12. The drive unit as set forth in claim 11, wherein a bottom surface of the solid waste chamber and a bottom surface of the upper chamber are inclined downward toward the inlet/outlet port.

13. The drive unit as set forth in claim 12, wherein the collection holes are disposed at an edge of the filter housing, each of the collection holes being open towards the inlet/outlet port.

14. A drive unit for dish washing machines, comprising:

a sump for receiving wash water;

a pump housing positioned inside the sump such that the pump housing is supported by the sump, the pump housing having a washing impeller located therein;

a flow channel housing disposed to cover a top of the pump housing, the flow channel housing having flow channels for guiding some of the wash water pumped out from the washing impeller to washing arms, a solid waste chamber for filtering some of the pumped-out wash water, and a communication hole positioned such that the communication hole is spaced from the solid waste chamber and from the washing impeller, the communication hole communicating with the sump for discharging water leaking from the solid waste chamber to the sump;

a filter housing positioned to cover the top of the flow channel housing, the filter housing having a filter opening, which corresponds to the solid waste chamber, collection holes communicating with the sump for conveying the wash water to the sump, and a communication hole located in an area surrounded by the filter opening and the solid waste chamber for discharging water leaking from an upper chamber to the communication hole of the flow channel housing;

an arm holder disposed above the flow channel housing, the arm holder having a filter positioned to cover the filter opening of the filter housing; and fixing members for securely attaching the pump housing, the flow channel housing, the filter housing and the arm holder to the sump, wherein the upper chamber has a bottom surface that is higher, by a predetermined amount, than a bottom surface of the solid waste chamber such that the bottom surfaces of the upper chamber and the solid waste chamber are configured to define a stepped structure, the upper chamber communicating with the solid waste chamber, and the filter of the arm holder is positioned to cover the solid waste chamber and the upper chamber.

* * * * *